US006231964B1

(12) United States Patent
Miller, Jr. et al.

(10) Patent No.: US 6,231,964 B1
(45) Date of Patent: May 15, 2001

(54) THERMAL TRANSFER RIBBONS WITH LARGE SIZE WAX OR RESIN PARTICLES

(75) Inventors: Thomas C. Miller, Jr., Kettering; Yaoping Tan, Miamisburg; Thomas J. Obringer, Vandalia, all of OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/107,139

(22) Filed: Jun. 30, 1998

(51) Int. Cl.[7] ..... B41M 5/26

(52) U.S. Cl. ..... 428/323; 428/206; 428/327; 428/484; 428/913; 428/914

(58) Field of Search ..... 428/195, 323, 428/484, 212, 488.1, 206, 327, 913, 914; 503/207

(56) References Cited

U.S. PATENT DOCUMENTS

| | | | |
|---|---|---|---|
| 3,663,278 | 5/1972 | Blose et al. . | |
| 4,315,643 | 2/1982 | Tokunaga et al. . | |
| 4,403,224 | 9/1983 | Wirnowski . | |
| 4,463,034 | 7/1984 | Tokunaga et al. . | |
| 4,523,207 | 6/1985 | Lewis et al. . | |
| 4,547,088 | 10/1985 | Shattuck . | |
| 4,628,000 | 12/1986 | Talvalkar et al. . | |
| 4,687,701 | 8/1987 | Knirsch et al. . | |
| 4,698,268 | 10/1987 | Ueyama . | |
| 4,707,395 | 11/1987 | Ueyama et al. . | |
| 4,744,685 | 5/1988 | Mecke et al. . | |
| 4,777,079 | 10/1988 | Nagamoto et al. . | |
| 4,778,729 | 10/1988 | Mizobuchi . | |
| 4,869,941 | 9/1989 | Ohki . | |
| 4,870,427 | 9/1989 | Kobayashi et al. . | |
| 4,910,113 | 3/1990 | Mori et al. . | |
| 4,923,749 | 5/1990 | Talvalkar . | |
| 4,938,617 | 7/1990 | Mecke et al. . | |
| 4,975,332 | 12/1990 | Shini et al. . | |
| 4,983,446 | 1/1991 | Taniguchi et al. . | |
| 4,983,681 | 1/1991 | Mori et al. . | |
| 4,988,563 | 1/1991 | Wehr . | |
| 5,128,308 | 7/1992 | Talvalkar . | |
| 5,132,139 | 7/1992 | Mecke et al. . | |
| 5,240,781 | 8/1993 | Obata et al. . | |
| 5,248,652 | 9/1993 | Talvalkar . | |
| 5,348,348 | 9/1994 | Hanada et al. . | |
| 5,714,249 * | 2/1998 | Yoshida et al. | 428/327 |

* cited by examiner

*Primary Examiner*—Pamela R. Schwartz
(74) *Attorney, Agent, or Firm*—Millen White Zelano & Branigan, P.C.

(57) ABSTRACT

Thermal transfer ribbons with large wax or thermoplastic resin particles within the thermal transfer layer provide a profiled surface which resists transfer of the layer to reverse side of the ribbon when wound onto itself and stored. The large particles preferably have an average diameter in the range of 5 to 20 microns and the thermal transfer layers preferably have an average thickness of less than the average diameter of these large particles. Where the large particles have higher softening temperatures in the range of 50° to 150° C., the energy needed to transfer the thermal transfer layer is reduced.

14 Claims, 1 Drawing Sheet

THERMAL TRANSFER RIBBONS WITH LARGE SIZE WAX OR RESIN PARTICLES

FIELD OF THE INVENTION

This invention pertains to thermal transfer ribbons derived from wax dispersions and emulsions. Such ribbons find use in thermal transfer printing wherein images are formed on a receiving substrate by selectively transferring portions of a pigment layer of a print ribbon to a receiving substrate by heating extremely precise areas thereof with thin film resistors within the print head of a thermal transfer printer. More particularly, the present invention relates to thermal transfer ribbons suitable for use in high speed thermal transfer printers.

BACKGROUND OF THE INVENTION

Thermal transfer printing is widely used in special applications such as in the printing of machine-readable bar codes on labels or directly on articles to be coded. The thermal transfer process employed by these printing methods provides great flexibility in generating images and allowing for broad variations in style, size and color of the printed images, typically from a single machine with a single thermal print head. Representative documentation in the area of thermal transfer printing includes the following patents:

U.S. Pat. No. 3,663,278, issued to J. H. Blose et al. on May 16, 1972, discloses a thermal transfer medium having a coating composition of cellulosic polymer, thermoplastic resin, plasticizer and a "sensible" material such as a dye or pigment.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga, et al. on Jul. 31, 1984, discloses a heat-sensitive magnetic transfer element having a hot melt or a solvent coating.

U.S. Pat. No. 4,523,207, issued to M. W. Lewis et al. on Jun. 11, 1985, discloses a multiple copy thermal record sheet which uses crystal violet lactone and a phenolic resin.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,687,701, issued to K. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama, et al., on Nov. 17, 1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

U.S. Pat. No. 4,778,729, issued to A. Mitsubishi on Oct. 18, 1988, discloses a heat transfer sheet comprising a hot melt ink layer on one surface of a film and a filling layer laminated on the ink layer.

U.S. Pat. No. 4,869,941, issued to Ohki on Sep. 26, 1989, discloses an imaged substrate with a protective layer laminated on the imaged surface.

U.S. Pat. No. 4,923,749, issued to Talvalkar on May 8, 1990, discloses a thermal transfer ribbon which comprises two layers, a thermal sensitive layer and a protective layer, both of which are water based.

U.S. Pat. No. 4,975,332, issued to Shini et al. on Dec. 4, 1990, discloses a recording medium for transfer printing comprising a base film, an adhesiveness improving layer, an electrically resistant layer and a heat sensitive transfer ink layer.

U.S. Pat. No. 4,983,446, issued to Taniguchi et al. on Jan. 8, 1991, describes a thermal image transfer recording medium which comprises as a main component, a saturated linear polyester resin.

U.S. Pat. No. 4,988,563, issued to Wehr on Jan. 29, 1991, discloses a thermal transfer ribbon having a thermal sensitive coating and a protective coating. The protective coating is a wax-copolymer mixture which reduces ribbon offset.

U.S. Pat. Nos. 5,128,308 and 5,248,652, issued to Talvalkar, each disclose a thermal transfer ribbon having a reactive dye which generates color when exposed to heat from a thermal transfer printer.

And, U.S. Pat. No. 5,240,781, issued to Obatta et al., discloses an ink ribbon for thermal transfer printers having a thermal transfer layer comprising a wax-like substance as a main component and a thermoplastic adhesive layer having a film forming property.

High speed thermal transfer printers such as "near edge," "true edge," "corner edge" and "Fethr®" edge printers have been developed, wherein the thin film resistors are positioned right at the edge of the thermal print head, allowing rapid separation of the donor film from the receiving substrate after the thin film resistors are fired.

Conventional general purpose ribbons often cannot meet the requirements of high speed printers since the ribbon and receiving substrate are separated almost instantaneously after the thin film resistors are fired. There is little time for waxes and/or resins to melt/soften and flow onto the surface of the receiving substrate before the ribbon is separated from the receiving substrate. In conventional ribbons, the adhesion of the melted/softened material to the receiving substrate is typically lower than its adhesion to the supporting substrate of the ribbon at the time of separation with a high speed printer. As a result, the functioning thermal transfer layer is usually split and the transfer incomplete, resulting in light printed images where the functional layer is an ink layer.

To increase the speed of transfer of a functional layer to match the capability of high speed printers, waxes having a low melt temperature can be employed. A problem with this approach to utilizing the full capability of high speed printers is that the environmental stability of such ribbons decreases. As the melting point of the wax used to produce the ribbon decreases, the ribbon has a tendency to "block" wherein the coating transfers to the backside of the ribbon when wound onto itself. This blocking phenomenon tends to occur when the ribbon is subjected to temperatures in the range of 45° to 55° C. and when the ribbon is wound onto itself coating side in.

The thermal transfer layers of thermal transfer ribbons are typically of a thickness of 10 microns or less and preferably 5 microns or less, particularly for high speed printers. See for example, U.S. Pat. No. 4,547,088, column 2, lines 36–41; U.S. Pat. No. 4,938,617, column 4, lines 9–10; U.S. Pat. No. 4,744,685, column 3, lines 41–47; U.S. Pat. No. 4,870,727, column 17, lines 33–36; and U.S. Pat. No. 5,240,781, column 9, lines 51–53.

With these thin layers, the particle size of ribbon components such as pigments and other fillers are known to affect the resolution of the transferred image. See the Examples of U.S. Pat. No. 5,248,652 and U.S. Pat. No. 5,128,308 and see also U.S. Pat. No. 4,983,681 and U.S. Pat. No. 4,910,113. It is generally desirable to provide fine size pigments or other non melting components of the thermal transfer media.

In contrast to these typical ribbons Micke et al., U.S. Pat. No. 5,132,139 describes a thermal printing ribbon with multi strike capacity wherein the thermal transfer layer is preferably between 10 and 20 microns (see columns 7, line 21). For such thick thermal transfer layers, large size solid particles can be employed in the coating dispersion as is disclosed in column 5, lines 41–49.

SUMMARY OF THE INVENTION

It is an objective of the present invention to provide thermal transfer media such as a thermal transfer ribbon which produce high quality images with high speed thermal printers where the thermal transfer ribbon is separated from the receiving substrate almost instantaneously after the heating elements of the thermal transfer print head have been fired. It is another object of the present invention to provide thermal transfer media which comprise particles of wax or thermoplastic resin of a size greater than the average thickness of the thermal transfer layer in which they are incorporated. It is an additional object of the present invention to provide thermal transfer media such as thermal transfer ribbons with low softening temperature waxes which do not suffer from blocking when wound onto itself These and other objects of the present invention will become apparent from the detailed description and claims which follow together with the annexed drawings.

The present invention achieves these objects through the use of wax or thermoplastic resin of a large particle size, preferably in the range of 5 to 20 microns. It has also been found that with the use of such large sized particles, high melting point waxes such as polyethylene wax which do not melt during the printing process, tend to lower the transfer temperature of the entire pigmented layer.

The thermal transfer media of this invention comprises a flexible substrate with a thermal transfer layer deposited thereon. This thermal transfer layer comprises a sensible material, a water-dispersible or water emulsifiable wax, and optionally, a water-dispersible or water emulsifiable thermoplastic resin wherein the water-dispersible or emulsifiable wax or thermoplastic resin comprises large size particles having a melting point in the range of 50° C.–150° C. and a particle size greater than the thickness of the thermal transfer layer. In preferred embodiments, the thermal transfer layer has a thickness in the range of 3 to 5 microns and the large size wax and/or thermoplastic resin particles are of a size in the range of 5 to 15 microns. The large particles of wax or thermoplastic resin are preferably water-dispersible or emulsifiable and are preferably used in an amount in the range of 2 to 35 wt. %, based on the total weight of solids within the thermal transfer layer. The thermal transfer medium can include other layers wherein the large particles of wax and/or thermoplastic resin are present in the outer layer. In preferred embodiments, the particles comprise a high melting point wax such as low molecular weight polyethylene or carnauba wax. The large particle wax/thermoplastic resin provides a surface profile which limits contact between the thermal transfer layer and the reverse side of a thermal transfer medium when rolled onto itself. This limited contact reduces blocking.

The thermal transfer layer contains other wax components providing a total wax content in the range of about 35 to 95 weight percent, based on dry components, and may also contain thermoplastic resin in an amount in the range of 0 to 15 weight percent and contain carbon black or other colorants in the range of 5 to 20 wt.%. Preferably, the large size wax/thermoplastic resin particles have a higher melting point than the other waxes or resins.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
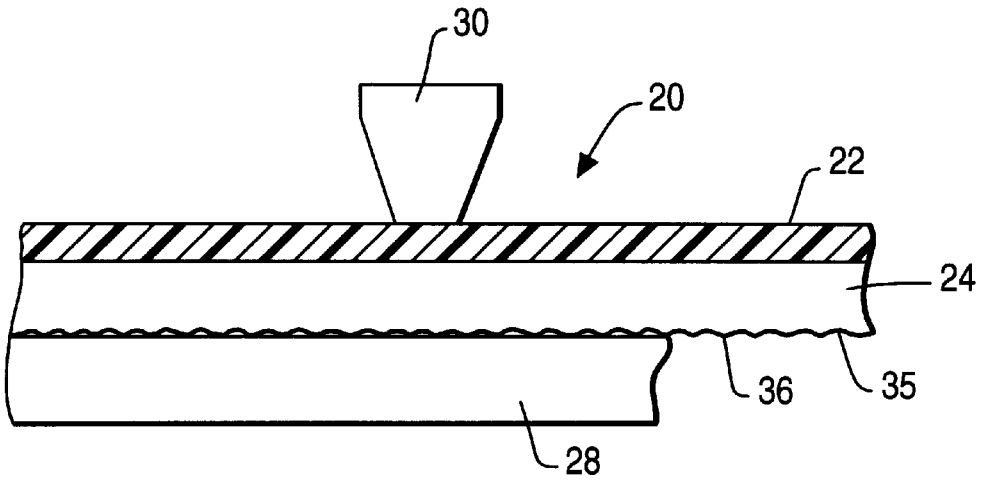
FIG. 1 illustrates a thermal transfer medium of the present invention in a printing operation prior to thermal transfer.
Figure 2:
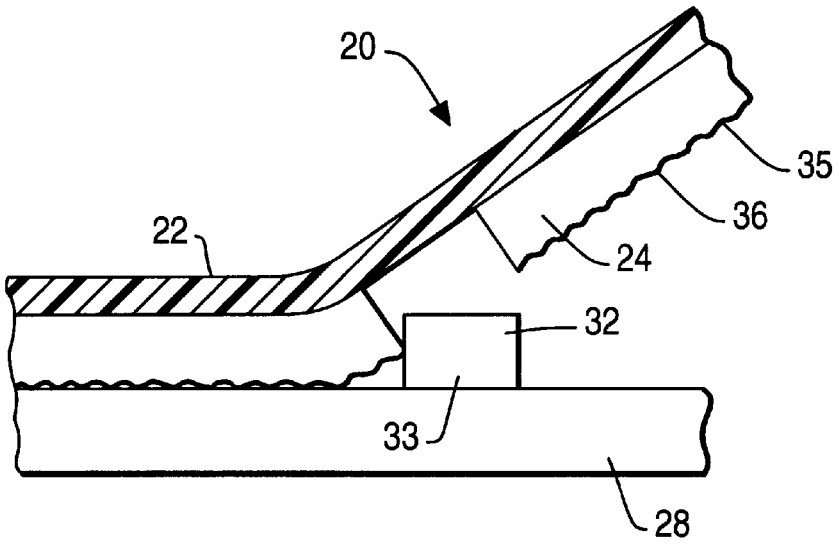
FIG. 2 illustrates a thermal transfer medium of the present invention in a printing operation after thermal transfer.

Thermal transfer ribbon 20, as illustrated in FIGS. 1–2, is a preferred embodiment of this invention and comprises substrate 22 of a flexible material which is preferably a thin smooth paper or plastic-like material. Tissue type paper materials such as 30–40 gauge capacitor tissue, manufactured by Glatz and polyester-type plastic materials such as 14–35 gauge polyester films manufactured by Dupont under the trademark Mylar® are suitable. Polyethylene napthalate films, polyethylene terephthalate films, polyamide films such as nylon, polyolefin films such as polypropylene film, cellulose films such as triacetate film and polycarbonate films are also suitable. The substrates should have high tensile strength to provide ease in handling and coating and preferably provide these properties at minimum thickness and low heat resistance to prolong the life of heating elements within thermal print heads. The thickness is preferably 3 to 50 microns. If desired, the substrate or base film may be provided with a back coating on the surface opposite the thermal transfer layer.

Positioned on substrate 22 is thermal transfer layer 24. This thermal transfer layer has a transfer temperature which enables the thermal transfer medium to be used in the high speed printers described above. To accomplish this, the softening point of the thermal transfer layer is below 150° C. and preferably from 50° C. to 150° C. Softening temperatures within this range enable the thermal transfer medium to be used in high speed thermal transfer printers such as "near edge," "true edge," and "Fethr™" thermal transfer printers wherein the thermal ribbon is separated from the receiving substrate almost instantaneously with the firing of heating elements within the thermal print head. Print heads are typically operated temperatures in the range of 100° C. to 300° C. The actual operating temperatures are too difficult to determine due to the small size of the heating elements.

The thermal transfer layer comprises large wax or thermoplastic resin particles which have a melting temperature or softening within the range of 50° C. to 150° C. These large particles have a diameter greater than the average thickness of the thermal transfer layer and provide protrusions 35 on the top surface 36 of the thermal transfer layer 24. The heat from print head 30 melts or softens thermal transfer layer 24 during transfer from substrate 22 to receiving substrate 28 forming image 32 which bonds to the substrate 28.

A thermal transfer layer of the thermal transfer medium of this invention preferably contains a water-emulsifiable wax or thermoplastic resin with a particle size ranging from 5 to 20 microns which is larger than the average thickness of the thermal transfer layer. The particle size preferably ranges from 5 to 15 microns where the thermal transfer layer has a thickness of from 3 to 5 microns. Particle sizes may be determined by a Horiba LA910 Particle Size Distribution Analyzer. These large particle components preferably range from 2 to 35 wt. % of the thermal transfer layer, based on total solids. There are limits on the amount of large sized particles used in that it leads to an increase in melt viscosity of the thermal transfer layer, restricting transfer by high speed thermal transfer printers. It has been found preferable to employ large particles with softening temperatures at the higher end of the range of 50° C. to 150° C. These higher melting temperature particles have been found to lower the transfer temperature of the entire system, ensuring complete transfer of the thermal transfer layer with high speed printers.

Large particle waxes and other waxes which can be used in the thermal transfer layers include natural waxes such as carnauba wax, candelilla wax, bees wax, rice bran wax; petroleum waxes such as paraffin wax; synthetic hydrocarbon waxes such as low molecular weight polyethylene and Fisher-Tropsch wax; higher fatty acids such as myristic acid, palmitic acid, stearic acid and behenic acid; higher aliphatic alcohols such as stearyl alcohol and esters such as sucrose fatty acid esters. Mixtures of waxes can also be used. Examples of preferred waxes are carnauba wax under the trade name S-Nauba™ by Shamrock Technologies and under the Slip-Ayd™ series of surface conditioners by Daniel Products Co. and low molecular weight polyethylene.

The melting point of the waxes falls within the range of from 50° C. to 150° C., preferably from 60° C. to 100° C. As indicated above, waxes with high melting points (100–150° C.) are advantageous when used for the large particles in that they reduce the energy necessary for transfer, particularly where the large particles are used in amount of about 10 wt. % of the thermal transfer layer, based on total solids. This is because the high melting waxes, e.g., polyethylene waxes, do not melt during printing. Thus, more energy is available for low melting waxes or resins and the overall viscosity of coating is lowered. The waxes with melting temperatures of 60–95° C. can also be used as particles to eliminate the blocking, such as S-Nauba. These waxes do melt during printing and, thus, do not provide lowering transfer temperature advantage.

The total amount of wax within the thermal transfer layer ranges from 35–95 wt. %, preferably 50–80 wt. %, based on the total weight of solids which includes the large particle wax as well as other soft waxes.

The thermal transfer layers of the thermal transfer media of the present invention may also contain a thermoplastic resin. The total amount of the thermoplastic resin is less than 20 wt. % and preferably ranges from 3 to 15 wt. %, based on total solids. The thermoplastic resin can comprise the large particles required of the thermal transfer layers of the present invention or a portion thereof. The thermoplastic resin must have a softening point within the range of 50° C. to 150° C. where used as a large particles. Suitable thermoplastic resins include those described in U.S. Pat. No. 5,240,781 and 5,348,348 and include the following resins: polyvinylchloride, polyvinyl acetate, vinyl chloride-vinyl acetate copolymers, polyethylene, polypropylene, polyacetal, ethylene-vinyl acetate copolymer, ethylene alkyl (meth)acrylate copolymer, ethylene-ethyl acetate copolymer, polystyrene, styrene copolymers, polyamide, ethylcellulose, epoxy resin, polyketone resin, polyurethane resin, polyvinyl butyryl, styrene-butadiene rubber, nitrile rubber, acrylic rubber, ethylene-propylene rubber, ethylene alkyl (meth)acrylate copolymer, styrene-alkyl (meth) acrylate copolymer, acrylic acid-ethylene-vinyl acetate terpolymer, saturated polyesters, and sucrose benzoate.

Preferred thermoplastic resins include alpha-methyl styrene-vinyl toluene copolymers such as those sold under the trade name "Piccotex™" by Hercules, Inc., sucrose benzoate, available as an alcohol soluble resin, polyketone resins such as "K-1717™," available from Lawter International Inc. and rosin esters, available commercially from Hercules, Inc. under the trade name "Stabilite™."

Another component of the thermal transfer layer of the present invention is a sensible material which is capable of being sensed visually, by optical means, by magnetic means, by electroconductive means or by photoelectric means. The sensible material is typically a coloring agent such as a dye or pigment or magnetic particles. Any coloring agent used in conventional ink ribbons is suitable, including carbon black and a variety of organic and inorganic coloring pigments and dyes. For example, phthalocyanine dyes, fluorescent naphthalimide dyes and others such as cadmium, primrose, chrome yellow, ultra marine blue, iron oxide, cobalt oxide, nickel oxide, etc. In the case of the magnetic thermal printing, the thermal transfer coating includes a magnetic pigment or particles for use in imaging or in coating operations to enable optical, human or machine reading of the characters. The magnetic particles in the thermal transfer ribbon provide the advantages of thermal printing while encoding or imaging the substrate with a magnetic signal inducible ink. The sensible material is typically used in an amount from about 5 to 60 parts by weight of the total dry ingredients of the coating formulation which provides the thermal transfer layer.

Preferred sensible materials are those which can be solubilized, dispersed or emulsified in water. The most common of such sensible materials is carbon black. Suitable water dispersible or emulsifiable carbon blacks are those available from Environmental Inks and BASF.

The thermal transfer layer may contain plasticizers, such as those described in U.S. Pat. No. 3,663,278, to aid in processing of the thermal transfer layer. Suitable plasticizers are adipic acid esters, phthalic acid esters, ricinoleic acid esters sebasic acid esters, succinic acid esters, chlorinated diphenyls, citrates, epoxides, glycerols, glycols, hydrocarbons, chlorinated hydrocarbons, phosphates, and the like. The plasticizer provides low temperature sensitivity and flexibility to the thermal transfer layer so as not to flake off the substrate.

The thermal transfer layer may contain other additives including flexibilizers such as oil, weatherability improvers such a UV light absorbers, fillers, emulsifiers, dispersants, surfactants, defoaming agents, flow adjusters, leveling agents and photostabilizers. Examples of flow adjusters are low molecular weight organic polysiloxanes. An example of defoamers, i.e., surfactants, is Anti-Musal JIC which may be used in the amount of 0.1 to 10 wt. % based on total weight of solids within the thermal transfer layer. Examples of leveling agents are low molecular weight polysiloxane/polyether copolymers and modified organic polysiloxanes, which may be used in an amount of 0.01–10 wt. % based on the weight of solids within the thermal transfer layer.

The thermal transfer ribbon of the present invention may have two or more layers wherein the thermal transfer layer having large wax or thermoplastic resin particles is the outer layer.

The thermal transfer ribbon of the present invention can be prepared by applying a coating formulation to the substrate to form the thermal transfer layer by conventional coating techniques such as those which employ a Meyer Rod or similar wire-wound doctor bar set up on a typical solvent coating machine to provide a coating thickness, once dried, preferably in the range of 2 to 5 microns. Suitable thermal transfer layers are derived from coating formulations having approximately 20 to 55% by weight dry ingredients (solids). A temperature of approximately 100° F. to 150° F. is typically maintained during the entire coating process. After the coating is applied to the substrate, the substrate is typically passed through a dryer at an elevated temperature to ensure drying and adherence of the coating 24 onto substrate 22 in making the transfer ribbon 20.

The thermal transfer ribbon of the present invention provides all the advantages of thermal transfer printing. When the thermal transfer layer is exposed to the heating elements (thin film resistors) of the thermal transfer print head, the thermal transfer layer is transferred from the ribbon to the receiving substrate 28 in a manner to produce precisely defined characters 32. The thermal transfer layer can be fully transferred onto a receiving substrate with the use of high speed thermal transfer printers.

Without further elaboration is believed that one skilled in the art can using the preceding description, utilize the present invention to its fullest extent. The following preferred specific embodiments are, therefore to be construed as merely illustrative and are not limiting of the remainder of the disclosure in anyway whatsoever. All applications, patents and publications cited above and below are hereby incorporated by reference.

EXAMPLES

Example 1

A formulation with the components recited below in Table 1 is coated on 18 gage polyester film and dried at about 180° F. to obtain a thermal transfer ribbon of the prevent invention with a thermal transfer layer having a thickness in the range of 3 to 5 microns.

TABLE 1

| Ingredient | Range | Dry Percent | Wet Weight |
|---|---|---|---|
| Wax emulsion[1] | 50 to 80 wt. % | 69% | 276 |
| Carbon black[2] dispersion | 5 to 20 wt. % | 15% | 51.7 |
| Wax powder[3] | 5 to 35 wt. % | 10% | 10 |
| Polyethylene[4] oxide | 2 to 15 wt. % | 6% | 40.8 |

TABLE 1-continued

| Ingredient | Range | Dry Percent | Wet Weight |
|---|---|---|---|
| Wetting agent[5] | | | 2.5 |
| D.I. water | | | 119 |
| TOTALS | | 100 | 500 |

[1]Emulsion 22854 - carnauba/paraffin/resin emulsion.
[2]Ajack 2056 - carbon black dispersion (29%).
[3]S-Nauba ™ - carnauba wax, average particle size 5–15 microns.
[4]Polyox-N-10 ™ - polyethylene oxide.
[5]Surfynol 104 - wetting agent.

Full transfer of the coating from the ribbon is observed on a step wedge at a temperature in the range of 260° F. to 300° F. The ribbon is rolled onto itself and no blocking is observed on the back surface of the ribbon after 120 hours at 45° C.

Example 2

A formulation with the components recited below in Table 2 is coated on an 18 gage polyester film and dried at 180° F. to obtain a thermal transfer ribbon of the present invention with a thermal transfer layer having a thickness of from 2 to 3 microns.

TABLE 2

| Ingredient | Range | Dry Percent | Wet Weight |
|---|---|---|---|
| Wax emulsion[1] | 50 to 80 wt. % | 69% | 276 |
| Carbon black[2] dispersion | 5 to 20 wt. % | 15% | 51.7 |
| Polyethylene[4] oxide | 2 to 15 wt. % | 6% | 40.8 |
| Wetting agent[5] | | | 2.5 |
| Thermoplastic powder[6] | 3–20 wt. % | 10% | 10 |
| D.I. water | | | 95.7 |
| TOTALS | | 100 | 500 |

[1]Emulsion 22854 - carnauba/paraffin/resin emulsion.
[2]Ajack 2056 - carbon black dispersion (29%).
[4]Polyox-N-10 ™ - polyethylene oxide.
[5]Surfynol 104 - wetting agent.
[6]Daniel SL-300 ™ - polyethylene, average particle size 5–15 microns.

The formulation is distinguished from that of Example 1 in that a large particle emulsion of polyethylene is used in place of the carnauba particles of Example 1. Full transfer of the coating from the ribbon is observed on a step wedge at a temperature in the range of 260° to 300° F. No blocking is observed on the ribbon once rolled onto itself and exposed to a temperature of 45° C. for 120 hours.

Example 3

A thermal transfer ribbon is prepared using coating formulation recited in Table 3 according to the procedures recited in Example 1.

TABLE 3

| Ingredient | Range | Dry Percent | Wet Weight |
|---|---|---|---|
| Wax emulsion[1] | 50 to 80 wt. % | 79% | 316 |
| Carbon black[2] dispersion | 5 to 10 wt. % | 15% | 51.7 |
| Wax powder | | | |

TABLE 3-continued

| Ingredient | Range | Dry Percent | Wet Weight |
|---|---|---|---|
| Polyethylene[4] oxide | 2 to 15 wt. % | 6% | 40.8 |
| Wetting agent[5] | | | 2.5 |
| D.I. water | | | 89 |
| TOTALS | | 100 | 500 |

[1]Emulsion 22854 - carnauba/paraffin/resin emulsion.
[2]Ajack 2056 - carbon black dispersion (29%).
[4]Polyox-N-10 ™ - polyethylene oxide.
[5]Surfynol 104 - wetting agent.

Full transfer of the coating from the ribbon is observed on a step wedge at a temperature in the range of 260° F. to 300° F. When the ribbon is wound onto itself and stored at 45° for 120 hours, blocking on the reverse side of the film is noticed.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A thermal transfer medium which comprises a flexible substrate and a thermal transfer layer deposited thereon, said thermal transfer layer comprising a sensible material dispersed in a binder, said binder consisting essentially of (a) 2 to 35 wt. %, based on total solids, of large particles of a water-dispersible or emulsifiable wax or thermoplastic resin having an average particle size in the range of 5 to 20 microns, said particles having a melting point or softening point in the range of 50° C. to 150° C., (b) a water-dispersible or emulsifiable wax having a particle size of less than 5 microns and a melting temperature or softening temperature in the range of 50° to 150° C., (c) 0 wt. % to 15 wt. % of a water-dispersible or emulsifiable thermoplastic resin having a particle size less than 5 microns and a melting temperature or softening temperature in the range of 50 to 150° C., and (d) a total amount of water-dispersible or emulsifiable wax having a melting/softening temperature in the range of 50° C. to 150° C. falling within the range of 35 to 95 wt. %, based on total solids, said thermal transfer layer having an average thickness less than the average particle size of said large particles of water-dispersible or emulsifiable wax or thermoplastic resin.

2. A thermal transfer ribbon as in claim 1, wherein the thermal transfer layer has a thickness in the range of 2 to 5 microns.

3. A thermal transfer ribbon as in claim 1, wherein the large particles of water dispersible or emulsifiable wax or thermoplastic resin have a size in the range of 5 to 15 microns.

4. A thermal transfer ribbon as in claim 1, wherein the large particles of water dispersible or emulsifiable wax or thermoplastic resin have a melting point or softening point in the range of 80° C. to 120° C. and do not melt during printing.

5. A thermal transfer ribbon as in claim 1, wherein the large particles of water dispersible or emulsifiable wax or thermoplastic resin have a melting point or softening point in the range of 60–95° C. and do melt during printing.

6. A thermal transfer ribbon as in claim 5, wherein the quantity of large particles comprises 5 to 15 wt. % of the thermal transfer layer based on total solids.

7. A thermal transfer ribbon as in claim 6, wherein the large particles comprise carnauba wax particles or polyethylene particles.

8. A thermal transfer ribbon as in claim 1, wherein the water emulsifiable or dispersible wax having a particle size less than 5 microns comprises a blend of carnauba wax and paraffin wax having a melting temperature or softening temperature in the range of 50° to 150° C.

9. A thermal transfer ribbon as in claim 8, wherein the thermal transfer layer has a softening temperature greater than 60° C.

10. A thermal transfer ribbon as in claim 9, which does not transfer to the backside of the flexible substrate when wound onto itself at 45° to 50° C. for over 120 hours.

11. A thermal transfer ribbon as in claim 10, wherein the thermal transfer layer has an average thickness of less than ½ the average diameter of the large particles of water emulsifiable or dispersible wax or thermoplastic resins.

12. A thermal transfer ribbon as in claim 11, wherein the large particles of water-dispersible or emulsifiable wax or thermoplastic resin have a size less than 15 microns with a standard deviation of less than 5 microns.

13. A thermal transfer ribbon as in claim 1, wherein the wax having a particle size less than 5 microns is selected from candelilla, carnauba and paraffin waxes.

14. A thermal transfer ribbon as in claim 1, wherein the thermal transfer layer completely transfers to a substrate when exposed to the operating print head of a high speed thermal transfer printer.

* * * * *